US006005572A

United States Patent [19]

Kurihara

[11] Patent Number: 6,005,572

[45] Date of Patent: Dec. 21, 1999

[54] DISPLAY UNIT HAVING PLURALITY OF FRAME BUFFERS

[75] Inventor: Katsuhide Kurihara, Kawasaki, Japan

[73] Assignee: Fujitsu Limited, Kawasaki, Japan

[21] Appl. No.: 08/237,184

[22] Filed: May 3, 1994

[30] Foreign Application Priority Data

Jun. 28, 1993 [JP] Japan ..... 5-157397

[51] Int. Cl.[6] ..... G09G 5/14

[52] U.S. Cl. ..... 345/340; 345/511

[58] Field of Search ..... 345/189, 190, 345/191, 201, 118, 119, 120, 340, 115, 342, 508, 511; 395/157, 158

[56] References Cited

U.S. PATENT DOCUMENTS

| | | | |
|---|---|---|---|
| 4,780,712 | 10/1988 | Itaya | 345/201 |
| 4,897,636 | 1/1990 | Nishi | 345/121 |
| 4,940,971 | 7/1990 | Hasebe | 345/120 |
| 5,001,469 | 3/1991 | Pappas | 345/120 |
| 5,029,112 | 7/1991 | Sakamoto | 345/201 |
| 5,101,365 | 3/1992 | Westberg | 345/119 |

FOREIGN PATENT DOCUMENTS

| | | |
|---|---|---|
| 3-235993 | 10/1991 | Japan . |
| 4-52686 | 2/1992 | Japan . |
| 4-225395 | 8/1992 | Japan . |

OTHER PUBLICATIONS

Micro Diversions, Inc. Advertisement, "Screensplitter" Byte. May 1978. p. 81.

Barden, W. "Color Computer Assembly Language Programming" Ft Worth 1983. pp. 25–29.

*Primary Examiner*—Matthew Luu
*Attorney, Agent, or Firm*—Staas & Halsey

[57] ABSTRACT

A display unit which displays images on a screen and transfers images from a first area on the screen to a second area on the screen. A plurality of frame buffers each have an area corresponding to the total area of the screen. A mask plane stores data indicating a respective frame buffer of the plurality of frame buffers in which image data for each pixel of the screen is stored. Images displayed on the screen are formed by image data selected from the plurality of frame buffers in accordance with the data stored in the mask plane. A transfer mechanism transfers, within each of the plurality of frame buffers, image data in a first area of a respective frame buffer corresponding to the first area on the screen to a second area of the respective frame buffer corresponding to the second area on the screen. The display unit uses the transferred image data in the second areas of the plurality of frame buffers to move the images in the first area on the screen to the second area on the screen.

12 Claims, 14 Drawing Sheets

FIG.2B

| NOT USED | $b_1$ | $b_0$ |
|---|---|---|

FIG.2C

| $b_1$ | $b_0$ | ACCESSED MEMORY |
|---|---|---|
| 0 | 1 | A (FIRST FRAME BUFFER 22) |
| 1 | 0 | B (SECOND FRAME BUFFER 23) |
| 1 | 1 | A and B |
| 0 | 0 | MASK PLANE |

DISPLAY UNIT HAVING PLURALITY OF FRAME BUFFERS

BACKGROUND OF THE INVENTION (1) Field of the Invention

The present invention generally relates to a display unit having a plurality of frame buffers, and more particularly to a display unit in which a plurality of windows overlapping each other are displayed using a plurality of frame buffers.

(2) Description of the Related Art

In recent years, it is required, in the field of computer graphics, to easily and rapidly process image data. In addition, a display unit having a multi-window function has been proposed, in which function a plurality of windows are opened on a single screen, sentences, tables and graphics being displayed on the respective windows. In the display unit having the multi-window function, a transfer process for transferring a part of an image displayed on a screen is often performed, and it is desired to increase the speed of the transfer process.

Conventionally, a display unit having two frame buffers has been proposed. This display unit is referred to as a double buffering display unit. The two frame buffers in the double buffering display unit are respectively referred to, for example, as a plane A and a plane B. Normally, the plane A and the plane B in the double buffering display unit are used as follows. While an image corresponding to image data stored in one of the planes A and B is being displayed on the screen, image data stored in another plane is updated. The planes A and B are then switched so that an image corresponding to the updated data stored in the other plane is displayed on the screen.

In the double buffering display unit having the multi-window function, it is managed whether image data for each window is stored in the plane A or the plane B. Images corresponding to image data for a plurality of windows stored in both the planes A and B are superimposed and displayed on the screen. In the transfer process, it is determined whether image data for each window is stored in the plane A or the plane B. If image data for a window is stored in the plane A, the image data for the window is transferred to (copied into) another area in the plane A. If image data for a window is stored in the plane B, the image data for the window is transferred to another area in the plane B. A process for transferring image data to another area is often referred to as a copy process. Images corresponding to the image data transferred to other areas in both the planes A and B are superimposed and displayed on the screen. As a result, the images for a plurality of windows are transferred on the screen.

In a control circuit for controlling the plane A and the plane B, the plane A and the plane B both of which are frame buffers are represented in different address spaces.

As has been described above, in a conventional double buffering display unit having the multi-window function, image data in the planes A and B is transferred window by window so that the images for the windows are transferred on the screen.

However, in a case where a plurality of windows are hierarchically formed so as to be overlapping each other on the screen as shown in FIG. 1A, it is difficult to transfer the images for a plurality of windows on the screen window by window. In FIG. 1A, windows W1, W2, W3 and W4 are opened on a screen, the window W1 including the windows W2 and W4 and the window W2 including the window W3.

The window W1 is referred to as a parent window of the windows W2, W3 and W4. Each of the windows W2, W3 and W4 is referred to as a child window of the parent window W1. Even if it is determined that image data for the parent window W1 is stored in one of the planes A and B, images for the parent window W1 and the child windows W2, W3 and W4 which are included in the parent window W1 are not transferred to another area on the screen in a batch processing, because image data for the child windows W2, W3 and W4 may be stored in different planes.

Thus, conventionally, images for a plurality of windows overlapping each other are transferred on the screen in accordance with steps shown in FIGS. 1A–1G.

In a case where images in an original area of the parent window W1 including the child windows W2, W3 and W4 are transferred to an area shown by the dotted line in FIG. 1A, the original area of the parent window W1 is divided into a plurality of rectangular areas R1–R13, as shown in FIG. 1B, so that image data for each rectangular area is stored in either plane A or B. Images for the rectangular areas R1–R13 are successively transferred to the other areas rectangular area by rectangular area, as shown in FIGS. 1C–1G, so that all the images in the original area are transferred to the other area on the screen. In this transfer process, it is determined whether image data for each rectangular area is stored in the plane A or the plane B. The image data for each rectangular area is then, based on the determination result, read out from an original area in the plane A or B and written into a transferred area in the plane A or B, so that the images for the windows W1, W2, W3 and W4 displayed on the screen are transferred to the other area as shown in FIG. 1G.

In the above transfer process, the area of the parent window W1 must be divided into a plurality of rectangular areas R1–R13, and it must be further determined whether image data for each rectangular area is stored in the plane A or in the plane B. Thus, images for a plurality of windows which are overlapped on the screen cannot be rapidly transferred.

SUMMARY OF THE INVENTION

Accordingly, a general object of the present invention relates to a novel and useful display unit having a plurality of frame buffers in which the disadvantages of the aforementioned prior art are eliminated.

A specific object of the present invention is to provide a display unit in which images for a plurality of windows which are displayed on a screen using a plurality of frame buffers can be rapidly transferred.

The above objects of the present invention are achieved by a display unit for displaying images included in a plurality of windows on a screen based on image data stored in a plurality of frame buffers, the display unit comprising: control means for controlling the plurality of frame buffers so that image data is written in and read out from the plurality of frame buffers; and a data transmission path coupling the control means and the plurality of frame buffers, the data transmission path having a capability according to which image data items to be written in and to be read out from all of the plurality of frame buffers are simultaneously transmitted therein.

According to the present invention, the image data items can be written in and read out from the plurality of frame buffers simultaneously via the data transmission path. Thus, images for a plurality of windows which are displayed on a screen using a plurality of frame buffers can be rapidly transferred.

The above objects are also achieved by a display unit for displaying images included in a plurality of windows on a screen based on image data stored in a plurality of frame buffers, the display unit comprising: initial setting means for identifying an area including images to be transferred on the screen; and transfer means for transferring image data in an area corresponding to the area identified by the initial setting means in each of the plurality of frame buffers, so that the images in the area identified by the initial setting means are transferred on the screen.

According to the present invention, since image data in areas corresponding to the same area identified by the initial setting means is transferred in the plurality of frame buffers, images can be transferred on the screen without determining the frame buffer in which image data included in each window is stored and without segmentation of the windows into the rectangular areas. Thus, image data can be rapidly transferred in each of the plurality of frame buffers so that images in the plurality of windows can be rapidly transferred on the screen.

Additional objects, features and advantages of the present invention will become apparent from the following detailed description when read in conjunction with the accompanying drawings.

BRIEF DESCRIPTION OF THE DRAWINGS

FIG. 2B is a diagram illustrating a structure of a control register provided in the display unit shown in FIG. 2A.

FIG. 2C is a table illustrating relationships between control bits b0 and b1 in the control register and planes (memories) to be accessed.

DESCRIPTION OF THE PREFERRED EMBODIMENTS

A description will now be given of a first embodiment of the present invention.

Figure 1A:
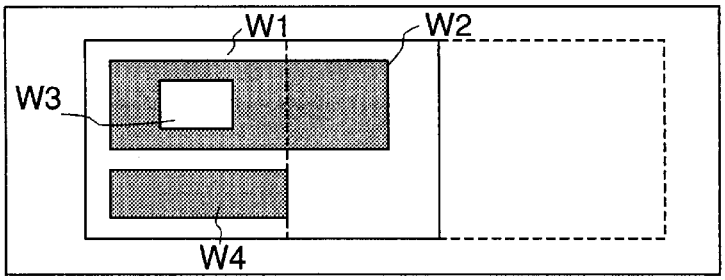
FIG.1A (PRIOR ART)
FIGS. 1A, 1B, 1C, 1D, 1E, 1F and 1G are diagrams illustrating conventional steps of transferring images for a plurality of windows which are overlapping.
Figure 1B:
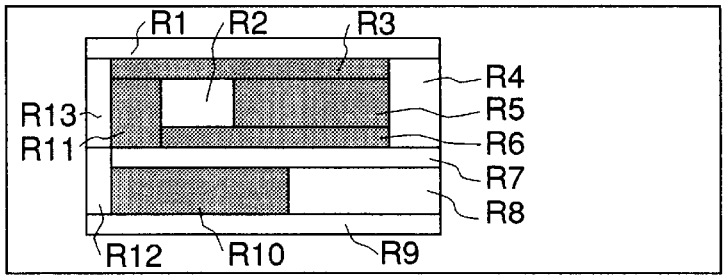
FIG.1B (PRIOR ART)
Figure 1C:
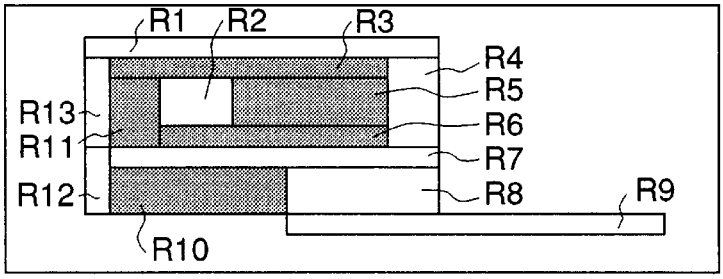
FIG.1C (PRIOR ART)
Figure 1D:
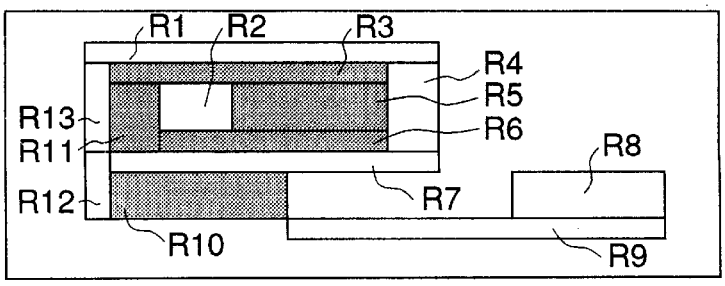
FIG.1D (PRIOR ART)
Figure 1E:
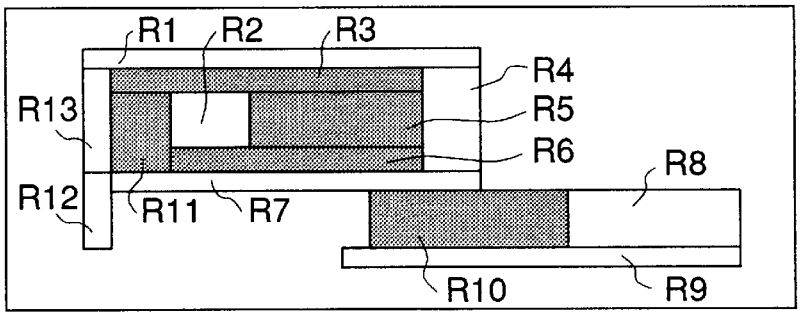
FIG.1E (PRIOR ART)
Figure 1F:
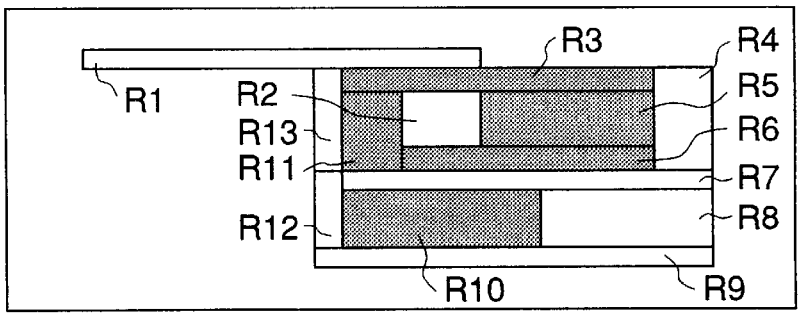
FIG.1F (PRIOR ART)
Figure 1G:
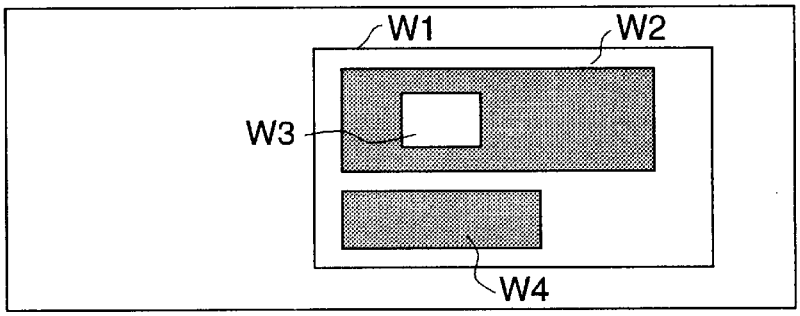
FIG.1G (PRIOR ART)
Figure 2A:
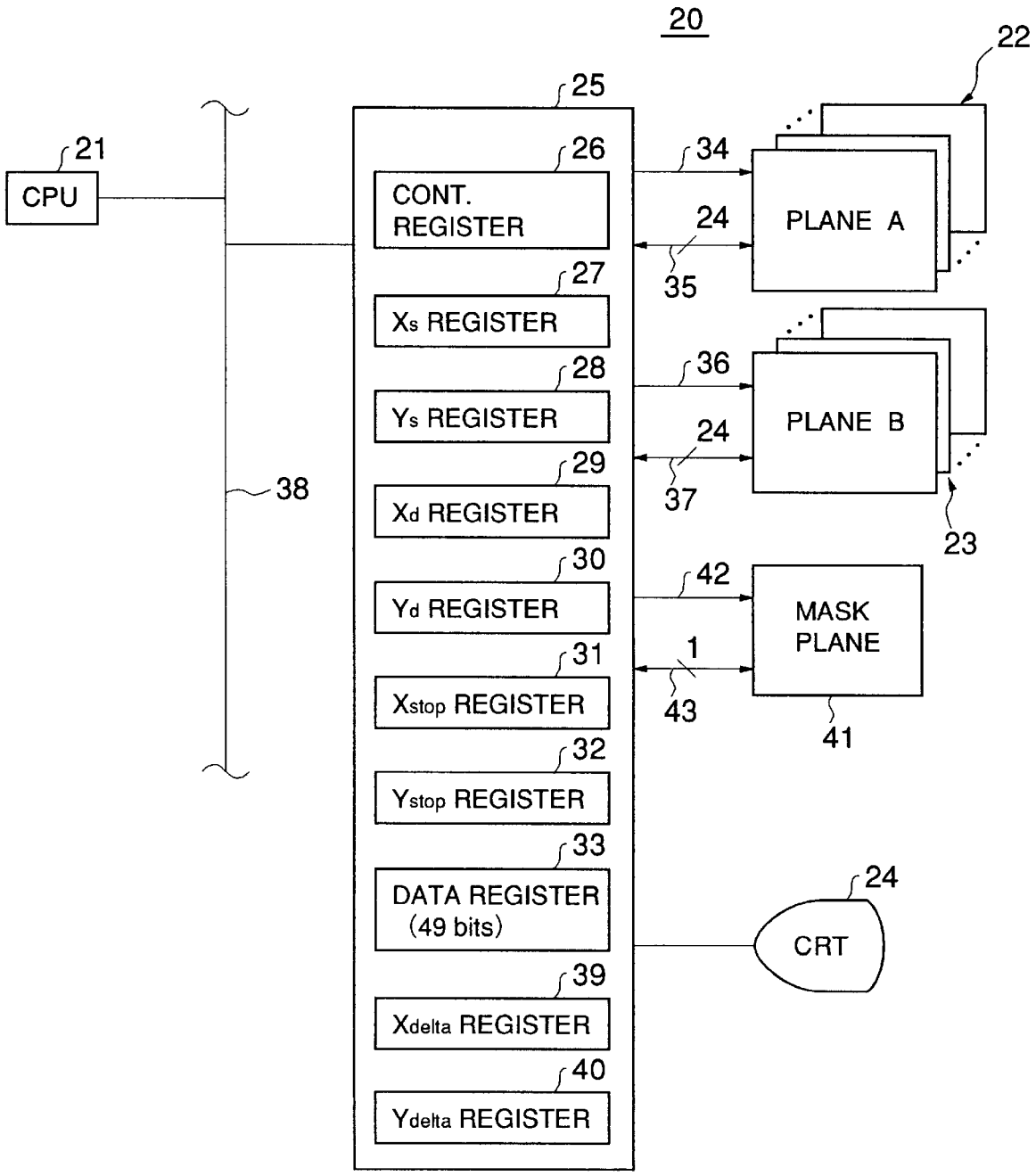
FIG. 2A is a block diagram illustrating a structure of a display unit according to an embodiment of the present invention.

A display unit having the multi-window function is formed as shown in FIG. 2A. Referring to FIG. 2A, the display unit 20 has a CPU (Central Processing Unit) 21, a first frame buffer 22 (the plane A), a second frame buffer 23 (the plane B), a mask plane 41 (a memory), a screen unit (CRT) 24 and a frame buffer control circuit 25. That is, this display unit 20 is a double buffering display unit. The CPU 21 and the frame buffer control circuit 25 are connected to each other by a data bus 38, and data is transmitted between the CPU 21 and the frame buffer control circuit 25 via the data bus 38. Image data to be displayed on the screen unit 24 is stored in the first and second frame buffers 22 and 23. The mask plane 41 corresponds to a screen of the screen unit 24, 1-bit data (0 or 1) representing whether each pixel on the screen should have image data stored in the first frame buffer 22 or the second frame buffer 23. The 1-bit data of "0" for a pixel represents, for example, that the pixel should have image data stored in the first frame buffer 22, and the 1-bit data of "1" for a pixel represents that the pixel should have image data stored in the second frame buffer 23.

The frame buffer control circuit 25 controls the first frame buffer 22, the second frame buffer 23 and the mask plane 41. The frame buffer control circuit 25 has a control register 26, registers 27, 28, 29, 30, 31, 32, 39 and 40 and a data register 33. The control register 26 is used to identify one of the first frame buffer 22, the second frame buffer 23 and the mask plane 41 which should be accessed. The registers 27, 28, 29, 30, 31, 32, 39 and 40 are used to transfer windows as will be described later. Image data and 1-bit data are temporarily stored in the data register 33. The frame buffer control circuit 25 generates video signals based on the image data supplied from the first and second frame buffers 22 and 23, and the video signals are supplied to the screen unit 24 so that images are displayed on the screen unit 24 based on the video signals.

The first frame buffer 22 and the frame buffer control circuit 25 are connected to each other by a control bus 34 and a data bus 35, the frame buffer control circuit 25 controlling the first frame buffer 22 via the control bus 34, and image data being transmitted between the frame buffer control circuit 25 and the first frame buffer 22. The second frame buffer 23 and the frame buffer control circuit 25 are connected to each other by a control bus 36 and a data bus 37, the frame buffer control circuit 25 controlling the second frame buffer 23 via the control bus 36, and image data being transmitted between the frame buffer control circuit 25 and the second frame buffer 23. The mask plane 41 and the frame buffer control circuit 25 are connected to each other by a control bus 42 and the data bus 43, the frame buffer control circuit 25 controlling the mask plane 41 via the control bus 42, and the 1-bit data being transmitted between the frame buffer control circuit 25 and the mask plane 41. Image data is represented by, for example, 24 bits, so that each of the data buses 35 and 37 for the first and second frame buffers 22 and 23 is 24 bits. The data bus 43 for the mask plane 41 is one bit. These data buses 35, 37 and 43 are bundled in the frame buffer control circuit 25 and coupled to the data resister 33. Thus, the data register 33 has a capacity of 49 bits, so that image data for the first frame buffer 22 and the second frame buffer 23 and the 1-bit data for the mask plane 41 can be simultaneously stored in the data register 33.

The control register 26 is formed as shown in FIG. 2B. In FIG. 2B, the upper bits of the control register 26 are not used, and the lower two bits b1 and b0 are used as control bits. The control bits (b1 b0) represent states as shown in FIG. 2C. That is, the control bits (0 1) represent that only the first frame buffer 22 (the plane A) is accessed, and the control bits (1 0) represent that only the second frame buffer 23 is accessed. Furthermore, the control bits (1 1) represent that both the first frame buffer 22 and the second frame buffer 23 are simultaneously accessed. The control bits (0 0) represent another state in which the mask plane 41 is accessed.

A normal writing operation is carried out as follows.

When image data to be displayed on the screen unit 24 is written in the first frame buffer 22, the image data (24 bits) is set in a first portion of the data register 33 and the control bits (b1 b0) of the control register 26 are set to (0 1). A control signal based on the control bits (0 1) is then supplied to the first frame buffer 22 via the control bus 34, so that only the first frame buffer 22 is activated. As a result, the image data supplied from the first portion of the data register 33 to the first frame buffer 22 via the data bus 35 is written in the first frame buffer 22. When image data to be displayed on the screen unit 24 is written in the second frame buffer 23, the image data (24 bits) is set in a second portion of the data register 33 and the control bits (b1 b0) of the control register 26 is set to (1 0). A control signal based on the control bits (1 0) is then supplied to the second frame buffer 23 via the control bus 36, so that only the second frame buffer 23 is activated. As a result, the image data supplied from the second portion of the data register 33 to the second frame buffer 23 via the data bus 37 is written in the second frame buffer 23. In addition, when 1-bit data indicating whether image data for each pixel to be displayed is stored in the first frame buffer 22 or the second frame buffer 23 is written in the mask plane 41, the 1-bit data is set in a third portion of the data register 33 and the control bits (b1 b0) of the control register 26 are set to (0 0). A control signal based on the control bits (0 0) is then supplied to the mask plane 41 via the control bus 42, so that only the mask plane 41 is activated. As a result, the 1-bit data supplied from the third portion of the data register 33 to the mask plane 41 via the data bus 43 is written in the mask plane 41.

The image data written in the first and second frame buffers 22 and 23 as has been described above is read out with reference to the mask plane 41, and images represented by the image data are displayed on the screen unit 24.

Figure 3:
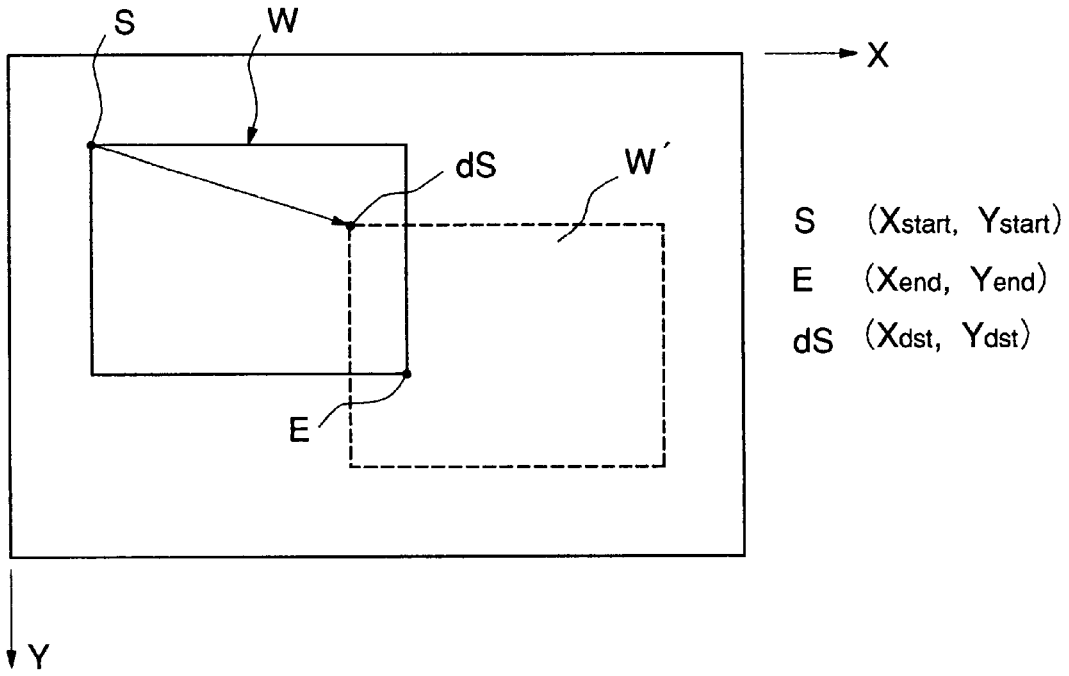
FIG. 3 is a diagram illustrating a relationship between an original area of window and a transferred area in an X-Y coordinate system.

The same coordinate system as shown in FIG. 3 is assigned to the first frame buffer 22, the second frame buffer 23, the mask plane 41 and the screen. In the coordinate system in which each point (pixel) is represented by an X-coordinate and a Y-coordinate, a left upper corner point S of a window W is represented by coordinates ($X_{start}$, $Y_{start}$), a right lower corner point E of the window W is represented by coordinates ($X_{end}$, $Y_{end}$). The left upper corner point S is defined as a starting point S, and the right lower corner point E is defined as an end point E. The window W is transferred to an area of the screen indicated by a dotted line in FIG. 3, the area being referred to as a transferred window W'. A left upper corner point dS of the transferred window W' is represented by coordinates ($X_{dst}$, $Y_{dst}$). The left upper corner point dS is defined as a transferred point dS.

Figure 5:
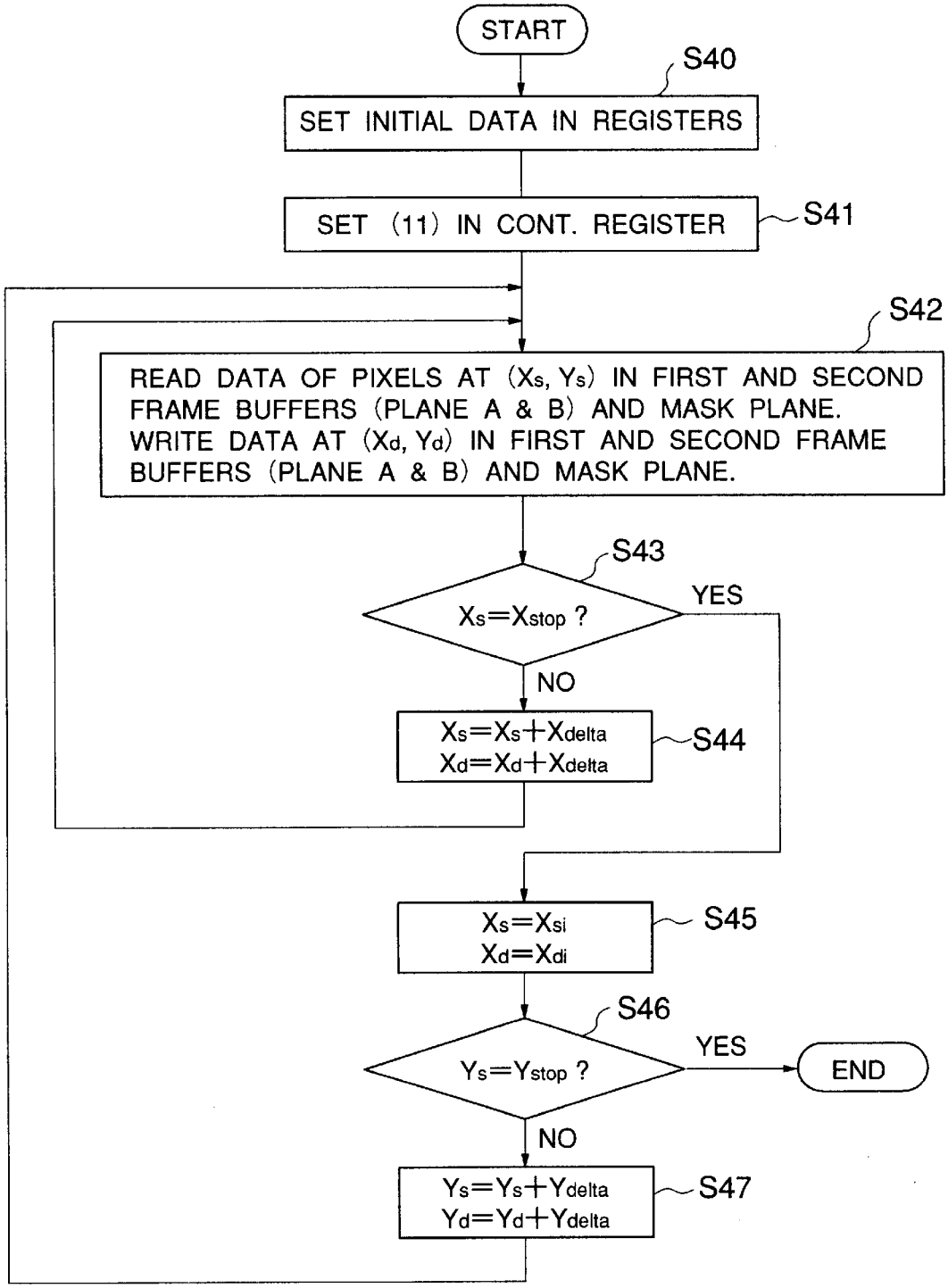
FIG. 5 is a flow chart illustrating a first embodiment of a process for transferring image data.

When an operator inputs to this display unit information (e.g. the starting point S and the end point E) identifying a window W to be transferred on the screen, information (e.g. the transferred point dS) identifying the transferred window W', and a start instruction, the frame buffer control circuit 25 starts to carry out a process as shown in FIG. 5. The window W to be transferred on the screen may be a parent window including one or a plurality of child windows.

Figure 4:
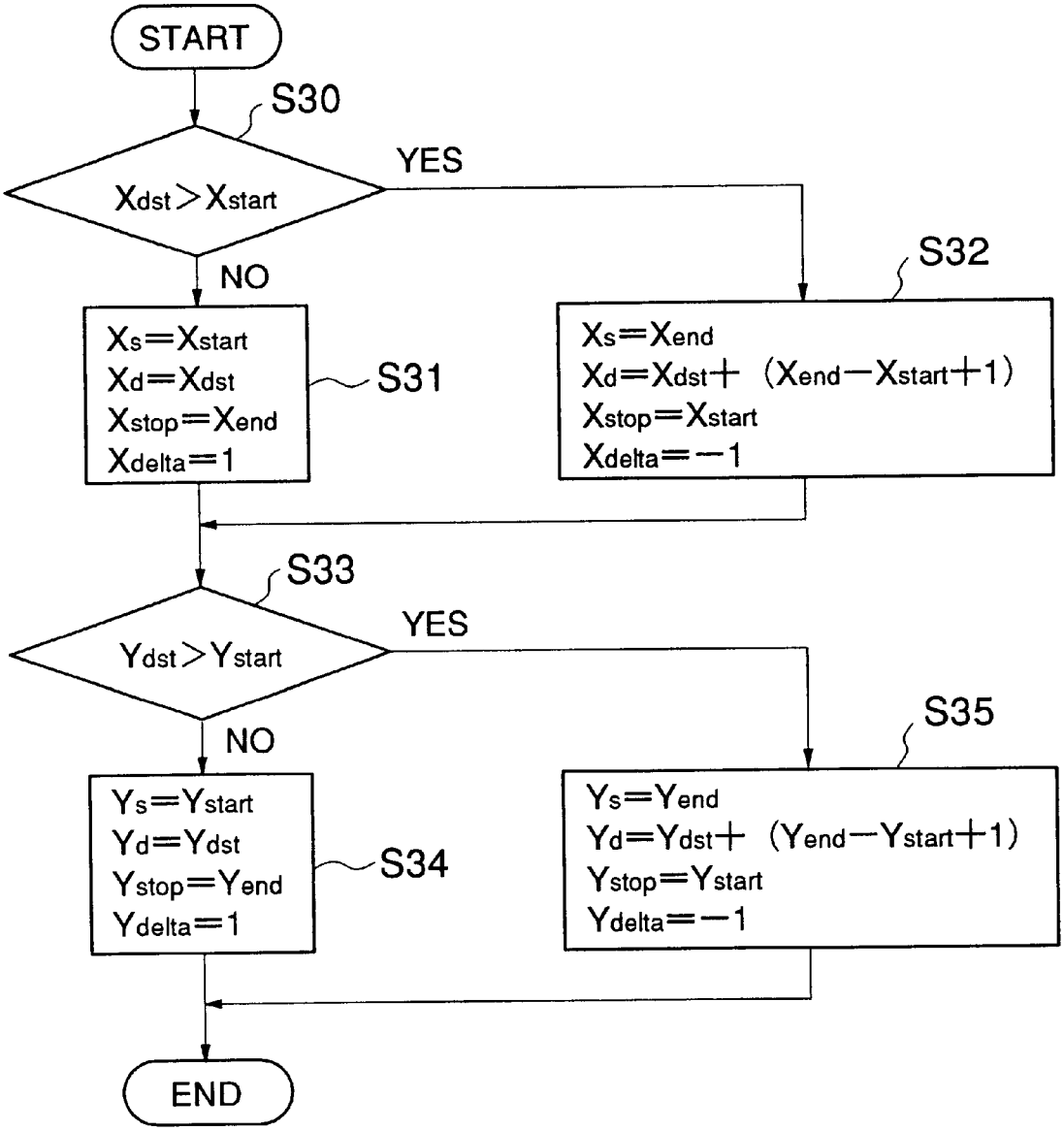
FIG. 4 is a flow chart illustrating a process for determining an order in accordance with which image data of pixels in the window are transferred.

Referring to FIG. 5, first, in step S40, a transfer order of image data for pixels from the window W to the transferred window W' is determined based on the direction in which the window W is to be transferred. In step S40, the frame buffer control circuit 25 carries out a process shown in FIG. 4. Referring to FIG. 4, it is determined, in step S30, whether or not the X coordinate value $X_{dst}$ of the transferred point dS of the transferred window W' is greater than the X coordinate value $X_{start}$ of the starting point S of the window W to be transferred. That is, it is determined whether or not the transferred point dS of the transferred window W' is positioned at the positive side of the starting point S of the window W to be transferred in the X-direction. If the X coordinate value $X_{dst}$ of the transferred point dS is not greater than the X coordinate value $X_{start}$ of the starting point S ($X_{dst} \leqq X_{start}$), in step S31, the X coordinate value $X_{start}$ of the starting point S is set in the Xs register 27, the X coordinate value $X_{dst}$ of the transferred point dS is set in the Xd register 29, and the X coordinate value $X_{end}$ of the end point E is set in the Xstop register 31. In addition, data +1 indicating an interval of pixels to be processed is set in the Xdelta register 39.

On the other hand, if it is determined, in step S30, that the X coordinate value $X_{dst}$ of the transferred point dS is greater than the X coordinate value $X_{start}$ of the starting point S ($X_{dst} > X_{start}$), in step S32, the X coordinate value $X_{end}$ of the end point E is set in the Xs register 27, a value calculated by $$X_{dst}+(X_{end}-X_{start}+1)$$

is set in the Xd register 29, and the X coordinate value $X_{start}$ of the start point S is set in the Xstop register 31. In addition, data −1 indicating an interval of pixels to be processed is set in the Xdelta register 39.

After the X coordinate values are set in the registers 27, 29 and 31 and the data +1 or −1 is set in the register 39, as has been described above, it is determined, in step S33, whether or not the Y coordinate value $Y_{dst}$ of the transferred point dS is greater than the Y coordinate value $Y_{start}$ of the starting point S. That is, it is determined whether or not the transferred point dS is positioned at the positive side of the starting point S in the Y direction. If it is determined, in step S33, that the Y coordinate value $Y_{dst}$ of the transferred point dS is not greater than the Y coordinate value $Y_{start}$ of the starting point S ($Y_{dst} \leqq Y_{start}$), in step S34, the Y coordinate value $Y_{start}$ of the starting point S is set in the Ys register 28, the Y coordinate value $Y_{dst}$ of the transferred point dS is set in the Yd register 30, and the Y coordinate value $Y_{end}$ of the end point E is set in the Ystop register 32. In addition, the data +1 is set in the Ydelta register 40.

On the other hand, if it is determined, in step S33, that the Y coordinate value $Y_{dst}$ of the transferred point dS is greater than the Y coordinate value $Y_{start}$ of the starting point S ($Y_{dst} > Y_{start}$), in step S35, the Y coordinate value $Y_{end}$ of the end point E is set in the Ys register 28, a value calculated as $$Y_{dst}+(Y_{end}-Y_{start}+1)$$

is set in the Yd register 30, and the Y coordinate value $Y_{start}$ of the starting point S is set in the Ystop register 32. In addition, the data −1 is set in the Ydelta register 40.

In a case where steps S31 and S34 are carried out, pixels in the window W are successively processed, in the transfer process (the copy process), starting from the pixel positioned at the starting point S of the window W, in the positive X and Y directions. In a case where steps S32 and S35 are carried out, pixels in the window W are successively processed, in the transfer process (the copy process), starting from the pixel positioned at the end point E of the window E, in the negative X and Y directions. In a case where steps S31 and S35 are carried out, pixels in the window W are successively processed, in the transfer process, starting from the pixel positioned at the left lower corner point of the window W, in the positive X direction and in the negative Y direction. In a case where steps S32 and S34 are carried out, pixels in the window W are successively processed, in the transfer process, starting from the pixel positioned at the right upper corner point of the window W, in the negative X direction and the positive Y direction.

In the example show in FIG. 3, if image data of a pixel positioned at the starting point S of the window W is copied into the transferred position dS, original image data of a pixel positioned at transferred position dS is erased. Thus, in this case, pixels in the window W must be processed starting from a pixel positioned at the end point E of the window W. That is, in this case, it is determined that the X coordinate value $X_{dst}$ of the transferred point dS is greater than the X coordinate value $X_{start}$ of the starting point S and the Y coordinate value $Y_{dst}$ of the transferred point dS is greater than the Y coordinate value $Y_{start}$ of the starting point, so that pixels in the window W are successively processed starting from a pixel positioned at the end point E.

Returning to FIG. 5, after the coordinate values are initially set in the registers in the frame buffer control circuit 25 as has been described above, control bits (1 1) are set in the control register 26 in step S41. Based on the control bits (1 1) set in the control register 26, the control signals are supplied to the first and second frame buffers 22 and 23 via the control buses 34 and 36. At this time, also, the control signal is supplied to the mask plane 41 via the control bus 42. As a result, the first and second frame buffers 22 and 23 and the mask plane 41 are activated. After this, in step S42, image data and 1-bit data of a pixel identified by coordinates (Xs, Ys), which coordinate values have been set in the Xs register 27 and the Ys register 28 respectively, are simultaneously read out from the first and second frame buffers 22 and 23 and the mask plane 41. The image data (24 bits) read out from the first frame buffer 22 is supplied to the frame buffer control circuit 25 via the data bus 35 and stored in the first portion of the data register 33, the image data (24 bits) read out from the second frame buffer 23 is supplied to the frame buffer control circuit 25 via the data bus 37 and stored in the second portion of the data register 33, and the 1-bit data (1 bit) read out from the mask plane 41 is supplied to the frame buffer control circuit 25 via the data bus 43 and stored in the third portion of the data register 33. Furthermore, in step 42, the data (49 bits) stored in the data register 33 is read out therefrom, and the image data and the 1-bit data are written at a position identified by coordinates (Xd, Yd), which coordinate values have been set in the Xd register 29 and the Yd register 30, in the first frame buffer 22, the second frame buffer 23 and the mask plane 41. As a result, the image data of a pixel identified by the coordinates (Xs, Ys) is copied (transferred) into a position identified by the coordinates (Xd, Yd) in each of the first and second frame buffers 22 and 23, and the 1-bit data of a pixel identified by the coordinates (Xs, Ys) is copied into a position identified by the coordinates (Xd, Yd) in the mask plane 41.

Next, in step S43, the frame buffer control circuit 25 determines whether or not the value in the Xs register 27 is equal to the value of the Xstop register 31. That is, it is determined whether or not all the pixels on the line identified by the Y coordinate value set in the Ys register 28 in the window W have been completely processed. If all the pixels on the line have not been processed yet, in step S44, the value of the Xs register 27 is updated so that the value (−1 or +1) set in the Xdelta register 39 is added to the value of the Xs register 27, and the value of the Xd register 27 is updated so that the value (−1 or +1) is added to the value of the Xd register 29. In a case where the value set in the Xdelta register 39 is equal to "−1", the Xs register 27 and the Xd register 28 are decremented by one in step 44. In a case where the value of the Xdelta register 39 is equal to "+1", the Xs register 27 and the Xd register 28 are incremented by one in step 44. That is, in step S44, a pixel to be processed is moved by one point in the X coordinate direction. After this, steps 42, 43 and 44 are repeatedly performed until all the pixels on the line identified by the Y coordinate set in the Ys register 28 in the window W are completely processed.

When it is determined, in step S43, that the value of the Xs register 27 is equal to the value of the Xstop register 31, all the pixels on the line identified by the Y coordinate value set in the Ys register 28 have been completely processed. Thus, values of the Xs register 27 and the Xd register 29 are respectively reset to initial values $X_{si}$ and $X_{di}$. The initial value $X_{si}$ is either the X coordinate value $X_{start}$ of the starting point S or the X coordinate value $X_{end}$ of the end point E. The initial value $X_{di}$ is either the X coordinate value $X_{dst}$ of the transferred point dS or the X coordinate value calculated as $\{X_{dst}+(X_{end}-X_{start}+1)\}$. It is then determined, in step S46, whether or not a value of the Ys register 28 is equal to a value of the Ystop register 32. That is, in step S46, it is determined whether or not all the pixels in the window W have been completely processed. If all the pixels in the window W have not been processed yet (Ys is not equal to Ystop), in step S47, the value in the Ys register 28 is updated so that the value (−1 or +1) in the Ydelta register 40 is added to the value in the Ys register 28, and the value (−1 or +1) is added to the value in the Yd register 30. In a case where the value in the Ydelta register 40 is equal to −1, the values in the Ys register 28 and the Yd register 30 are decremented by one. In a case where the value in the Ydelta register 40 is equal to +1, the values in the Ys register 28 and the Yd register 30 are incremented by one. That is, a line to be processed in the window W is moved by one line. After this, steps S42–S47 are repeatedly performed until all the pixels in the window W are completely processed. When it is determined, in step S46, that the value in the Ys register 28 is equal to the value of the Ystop register 32, all the pixels in the window W have been completely processed. That is, the transfer process is completed.

Figure 6A:
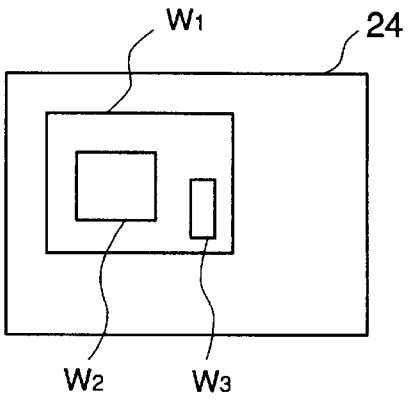
FIG. 6A is a diagram illustrating windows formed on a screen.
Figure 7A:
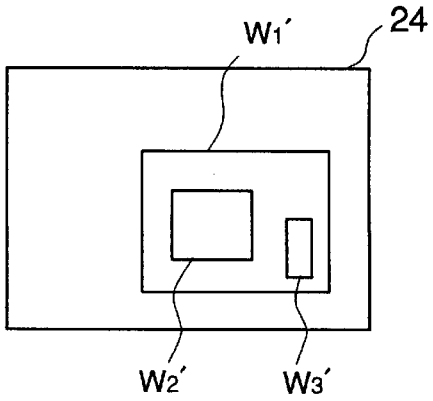
FIG. 7A is a diagram illustrating windows transferred on the screen.

In a case where a parent window W1 and child windows W2 and W3 as shown in FIG. 6A are transferred on the screen unit 24 so that the transferred windows W1', W2' and W3' are displayed on the screen unit 24 as shown in FIG. 7A, according to the transfer process described above, image data in the first and the second frame buffers 22 and 23 are processed as follows.

Figure 6B:
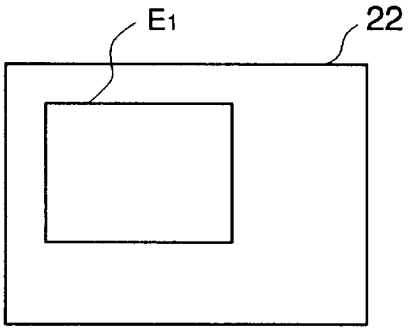
FIG. 6B is a diagram illustrating image data for a parent window W1 in the first frame buffer.
Figure 7B:
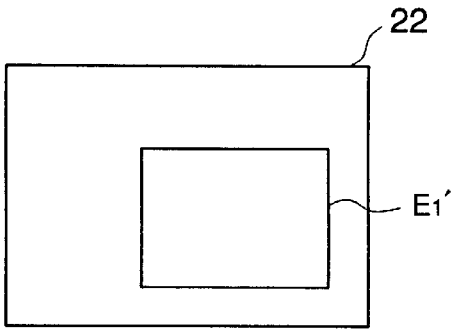
FIG. 7B is a diagram illustrating image data for the transferred window W1' in the first frame buffer.
Figure 6C:
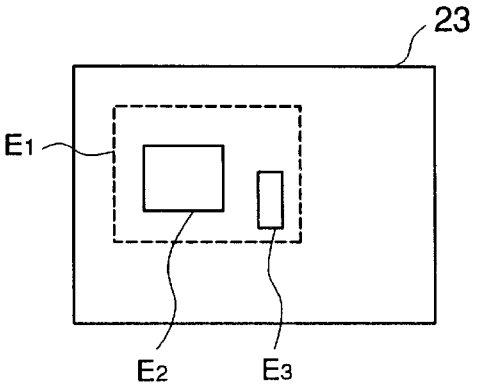
FIG. 6C is a diagram illustrating image data for child windows W2 and W3 of the parent window W1 in the second frame buffer.
Figure 7C:
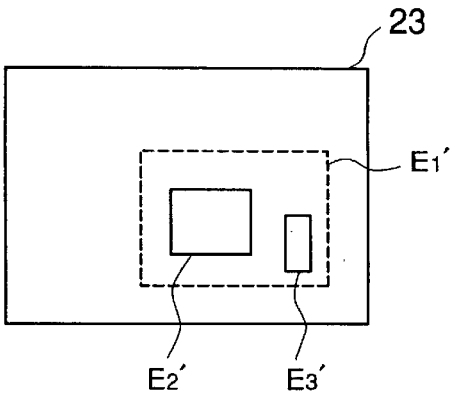
FIG. 7C is a diagram illustrating image data for the transferred windows W2' and W3' in the second frame buffer.

The image data in an area E1 corresponding to the parent window W1 in the first frame buffer 22 shown in FIG. 6B and the image data in an area E1 corresponding to the parent window W in the second frame buffer 23 shown in FIG. 6C are simultaneously copied into other areas E1' and E' corresponding to the transferred window W1' in the first and second frame buffers 22 and 23 shown in FIGS. 7B and 7C.

In the second frame buffer 23, since the image data in the area E1 corresponding to the parent window W1 is copied into the area E1' corresponding to the transferred window W1', image data in areas E2 and E3 corresponding to the child windows W2 and W3 included in the parent window W1 is automatically copied into areas E2' and E3' corresponding to the transferred areas W2' and W3' as shown in FIGS. 6C and 7C.

The 1-bit data in an area corresponding to the parent window W1 in the mask plane 41 is copied into another area corresponding to the transferred window W1' simultaneously with the image data.

According to the above embodiment, in each of the first and second frame buffers 22 and 23, image data in an area corresponding to the parent window is transferred to an area corresponding to the transferred window independently of whether image data included in each window is stored in the first frame buffer 22 or the second frame buffer 23. That is, it is not necessary to determine whether image data included in each window is stored in the first frame buffer 22 or the second frame buffer 23. In addition, even if the windows are hierarchically formed so as to overlap each other, image data in each window can be transferred to another area in each of the first and second frame buffers 22 and 23 without segmentation of the windows into the rectangular areas.

Thus, in the display unit according to the above embodiment, image data can be rapidly transferred in each of the first and second frame buffers 22 and 23 so that images in the plurality of windows can be rapidly transferred on the screen.

Furthermore, in the above embodiment, the image data (24 bits) read out from the first frame buffer 22 and the image data (24 bits) read out from the second frame buffer 23 are simultaneously set in the data register 33 of the frame buffer control circuit 25, so that the image data in an area corresponding to the window W in the first frame buffer 22 and the image data in an area corresponding to the window W in the second frame buffer 23 can be simultaneously transferred to other areas in the first and second frame buffers 22 and 23. Thus, the images in the windows can be further rapidly transferred on the screen.

A description will now be given of a second embodiment of the present invention.

Figure 8:
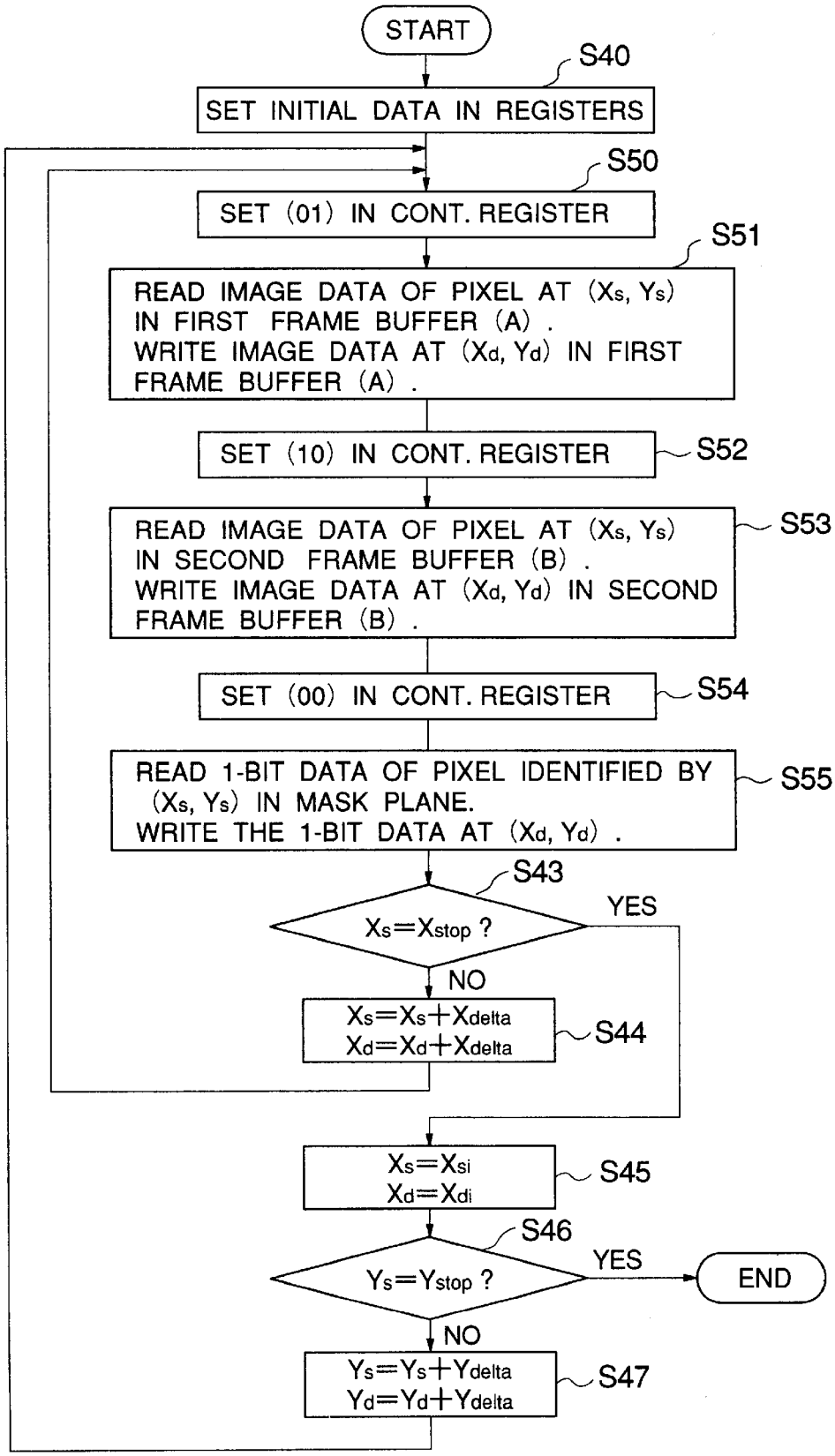
FIG. 8 is a flow chart illustrating a second embodiment of a process for transferring image data.

The display unit according to the second embodiment is formed as shown in FIG. 2A in the same manner as that according to the first embodiment. In the transfer process, the frame buffer control circuit 25 controls the first and second frame buffers 22 and 23 and the mask plane 41 in accordance with the flow chart shown in FIG. 8. In FIG. 8, those steps which are the same as those shown in FIG. 5 are given the same reference numbers.

Referring to FIG. 8, first, in step S40, various coordinate values are initially set in the registers 27, 28, 29, 30, 31 and 32 and the data −1 and/or +1 is initially set in the registers 39 and 40 in accordance with the process shown in FIG. 4. After this, control bits (0 1) are set in the control register 26 in step S50. As a result, the control signal based on the control bits (0 1) set in the control register 26 are supplied to the first frame buffer 22 via the control bus 34, so that only the first frame buffer 22 is activated. In step S51, image data (24 bits) of a pixel identified by coordinates (Xs, Ys) is read out from the first frame buffer 22, and only the image data is then stored in the first portion of the data register 33 of the frame buffer control circuit 25. Furthermore, in step S51, the image data stored in the data register 33 is returned to the first frame buffer 22 via the data bus 35 and written at a position identified by coordinates (Xd, Yd). After the image data of the pixel identified by the coordinates (Xs, Ys) is transferred to the position identified by the coordinates (Xd, Yd) in the first frame buffer 22, control bits (1 0) are set in the control register 26 in step S52. As a result, the control signal based on the control bits (1 0) set in the control register 26 is supplied to the second buffer 23 via the control bus 36, so that only the second frame buffer 23 is activated. In step S53, image data (24 bits) of the pixel identified by the coordinates (Xs, Ys) is read out from the second frame buffer 23, and only the image data is then stored in the second portion of the data register 33 of the frame buffer control circuit 25. Furthermore, in step S53, the image data stored in the data register 33 is returned to the second frame buffer 23 via the data bus 37 and written at a position identified by the coordinates (Xd, Yd). That is, the image data of the pixel identified by the coordinates (Xs, Ys) is transferred to the point identified by the coordinates (Xd, Yd) in the second frame buffer 23 in the same manner as that in the first frame buffer 22.

After this, control bits (0 0) are set in the control register 26 in step S54. As a result, the control signal based on the control bits (0 0) set in the control register 26 is supplied to the mask plane 41 via the control bus 42, so that only the mask plane 41 is activated. In step S55, the 1-bit data of the pixel identified by the coordinates (Xs, Ys) is read out from the mask frame 41, and only the 1-bit data is then stored in the third portion of the data register 33 of the frame buffer control circuit 25. Furthermore, in step S55, the 1-bit data stored in the data register 33 is returned to the mask plane 41 via the data bus 43 and written at a position identified by the coordinates (Xd, Yd). That is, the 1-bit data of the pixel identified by the coordinates (Xs, Ys) is transferred to the point identified by the coordinates (Xd, Yd) in the mask plane 41 in the same manner as the image data in both the first and second frame buffers 22 and 23.

After this, while the pixel to be processed is advanced by one each time in accordance with steps S43 and S44, the above process in steps S50–S55 is repeatedly performed. Further, while advancing the line to be processed by one each time in accordance with steps S45, S46 and S47, the processes S50–S55 and S43 and S44 are repeatedly performed. According to this, the image data in the area E1 corresponding to the parent window W1 is copied into the area E1' corresponding to the transferred window W1' in the first and second frame buffers 22 and 23, as shown in FIGS. 6B and 7B and FIGS. 6C and 7C. As a result, images in the windows W1, W2 and W3 are transferred on the screen so that images in the transferred windows W1', W2', and W3' are displayed thereon, as shown in FIGS. 6A and 7A.

According to the second embodiment, although the image data in the first frame buffer 22 and the image data in the second frame buffer 23 are not simultaneously transferred, in each of the first and second frame buffers 22 and 23, image data in an area corresponding to the parent window is transferred to an area corresponding to the transferred window without determination whether image data included in each window is stored in the first frame buffer 22 or the second frame buffer 23 and without segmentation of the windows into the rectangular areas. Thus, image data can be rapidly transferred in each of the first and second frame buffers 22 and 23 so that images in the plurality of windows can be rapidly transferred on the screen.

A description will now be given of a third embodiment of the present invention.

Figure 9:
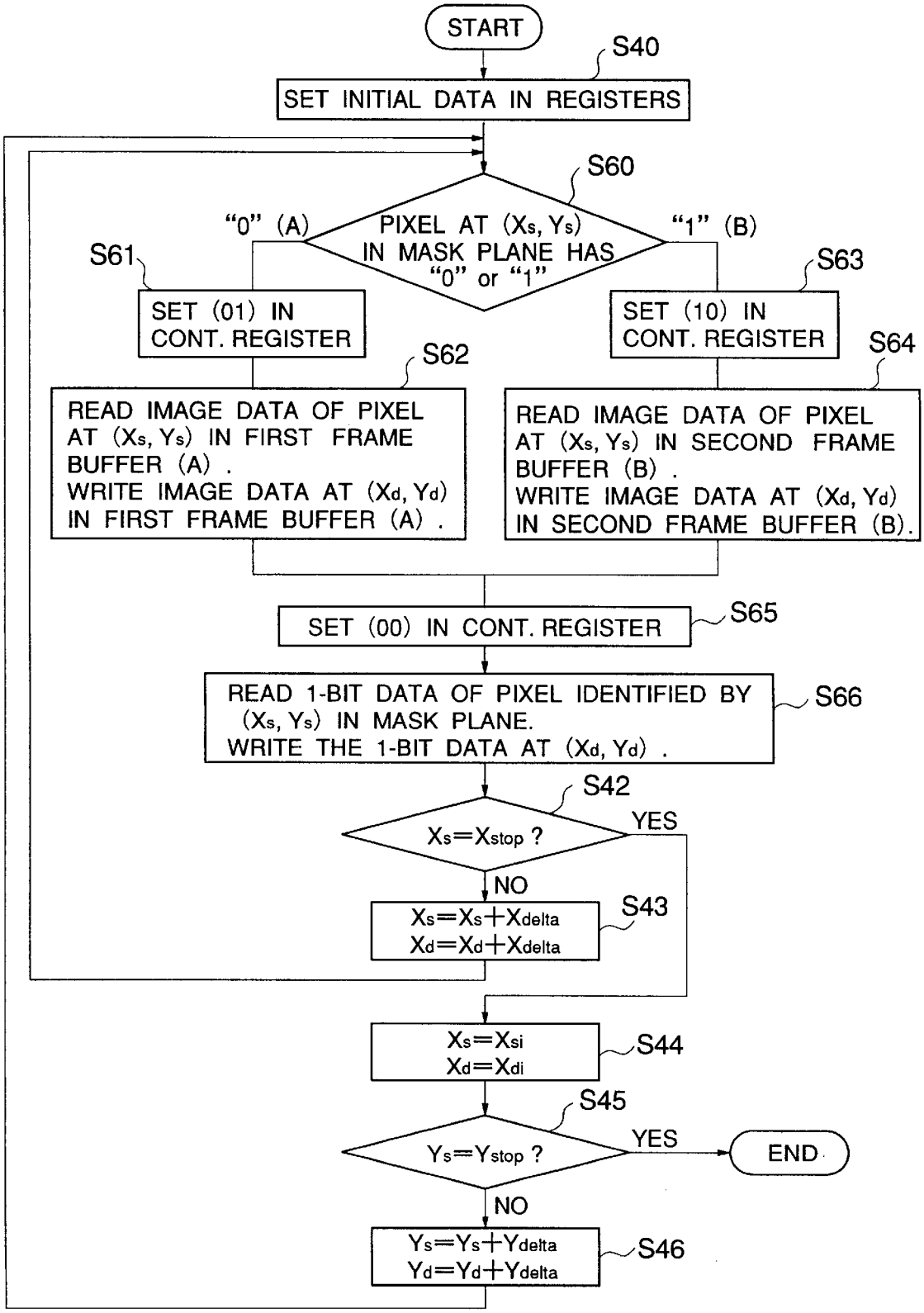
FIG. 9 is a flow chart illustrating a third embodiment of a process for transferring image data.

The display unit according to the third embodiment is formed as shown in FIG. 2A in the same manner as that according to the first and second embodiments. In the transfer process, the frame buffer control circuit 25 controls the first and second frame buffers 22 and 23 and the mask plane 41 in accordance with the flow chart shown in FIG. 9. In FIG. 9, those steps which are the same as those shown in FIG. 5 are given the same reference numbers.

Referring to FIG. 9, first, in step S40, various coordinate values are initially set in the registers 27, 28, 29, 30, 31 and 32 and the data −1 or +1 is initially set in the registers 39 and 40 in accordance with the process shown in FIG. 4. After this, in step S60, the frame buffer 25 determines whether data of a pixel identified by coordinates (Xs, Ys) in the mask plane 41 "0" or "1". That is, it is determined whether the pixel on the screen should have image data stored in the first frame buffer 22 or the second frame buffer 23. If it is determined, in step S60, that the data of the pixel identified by the coordinates (Xs, Ys) in the mask plane 41 is "0", indicating that the pixel on the screen should have image data stored in the first frame buffer 22, control bits (0 1) are set in the control register 26 in step S61. The control signal based on the control bits (0 1) set in the control register 26 is then supplied to the first frame buffer 22 via the control bus 34, so that only the first frame buffer 22 is activated. In step S62, image data of a pixel identified by the coordinates (Xs, Ys) is read out from the first frame buffer 22, and the image data is set in the first portion of the data register 33 of the frame buffer control circuit 25. Furthermore, in step S62, the image data set in the first portion of the data register 33 is read out and returned to the first frame buffer 22 via the data bus 35. The image data is then written at a position identified by coordinates (Xd, Yd) in the first frame buffer 22.

On the other hand, if it is determined, in step S60, that the data of the pixel identified by the coordinates (Xs, Ys) in the mask plane 41 is "1" representing that the pixel on the screen should have image data stored in the second frame buffer 23, control bits (1 0) are set in the control register 26 in step S63. The control signal based on the control bits (0 1) set in the control register is then supplied to the second frame buffer 23 via the control bus 36, so that only the second frame buffer 23 is activated. In step S64, image data of the pixel identified by the coordinates (Xs, Ys) is read out from the second frame buffer 23, and the image data is set in the second portion of the data register 33 of the frame buffer control circuit 25. Furthermore, in step S64, the image data set in the second portion of the data register 33 is read out and returned to the second frame buffer 23 via the data bus 37. The image data is then written at a position identified by the coordinates (Xd, Yd) in the second frame buffer 23.

After, the image data of the pixel identified by the coordinates (Xs, Ys) is transferred to the position identified by the coordinates (Xd, Yd) in either the first frame buffer 22 or the second frame buffer 23, control bits (0 0) are set in the control register 26 in step S65. The control signal based on the control bits (0 0) set in the control register is then supplied to the mask plane 41 via the control bus 42, so that only the mask plane 41 is activated. In step S66, data "0" or "1" of the pixel identified by the coordinates (Xs, Ys) is read out from the mask plane 41, and the data is set in the third portion of the data register 33 of the frame buffer control circuit 25. Furthermore, in step S66, the data set in the third portion of the data register 33 is read out and returned to the mask plane 41 via the data bus 43. The data is then written at a position identified by the coordinates (Xd, Yd) in the mask plane 41.

After this, due to steps S42–S46, the above process in steps S60–S66 is repeatedly performed, so that image data of all the pixels in an area identified by the starting point S ($X_{start}$, $Y_{start}$) and the end point ($X_{end}$, $Y_{end}$) is copied into a corresponding area identified by the transferred point dS ($X_{dst}$, $Y_{dst}$) in first and second frame buffers 22 and 23.

According to the third embodiment, in the first and second frame buffers 22 and 23, image data in an area corresponding to the parent window is transferred to an area corresponding to the transferred window without determination whether image data included in each window is stored in the first frame buffer 22 or the second frame buffer 23 and without segmentation of the windows into the rectangular areas. Thus, image data can be rapidly transferred in each of the first and second frame buffers 22 and 23 so that images in the plurality of windows can be rapidly transferred on the screen. In addition, since it is determined, with reference to the mask plane, whether image data of each pixel to be transferred is stored in the first frame buffer 22 or the second frame buffer 23, image data in an area corresponding to a window can be efficiently transferred to another area corresponding to a transferred window in both the first and second frame buffers 22 and 23.

A description will now be given of a fourth embodiment of the present invention.

Figure 10A:
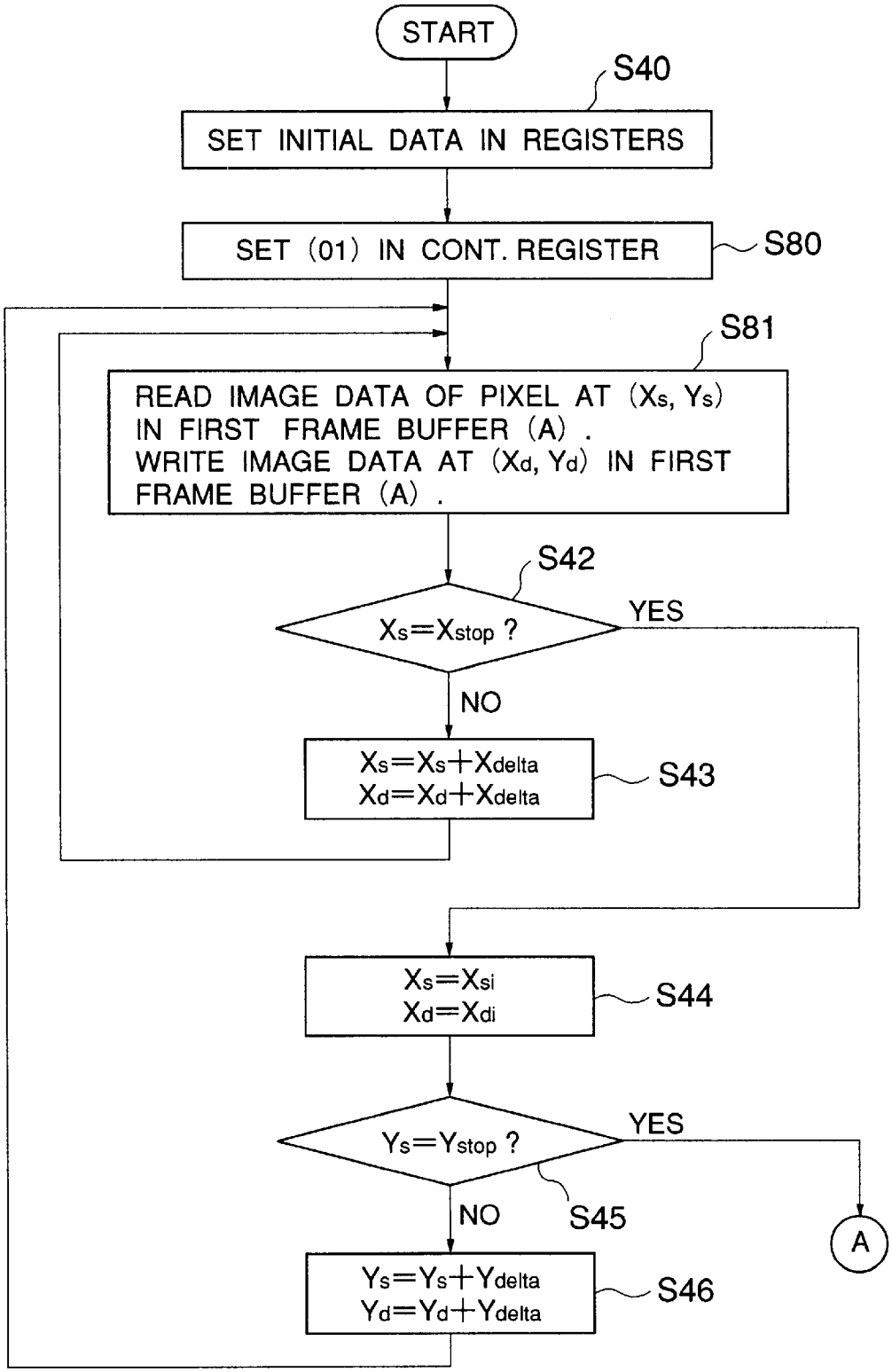
FIGS. 10A, 10B and 10C are flow charts illustrating a fourth embodiment of a process for transferring image data.
Figure 10B:
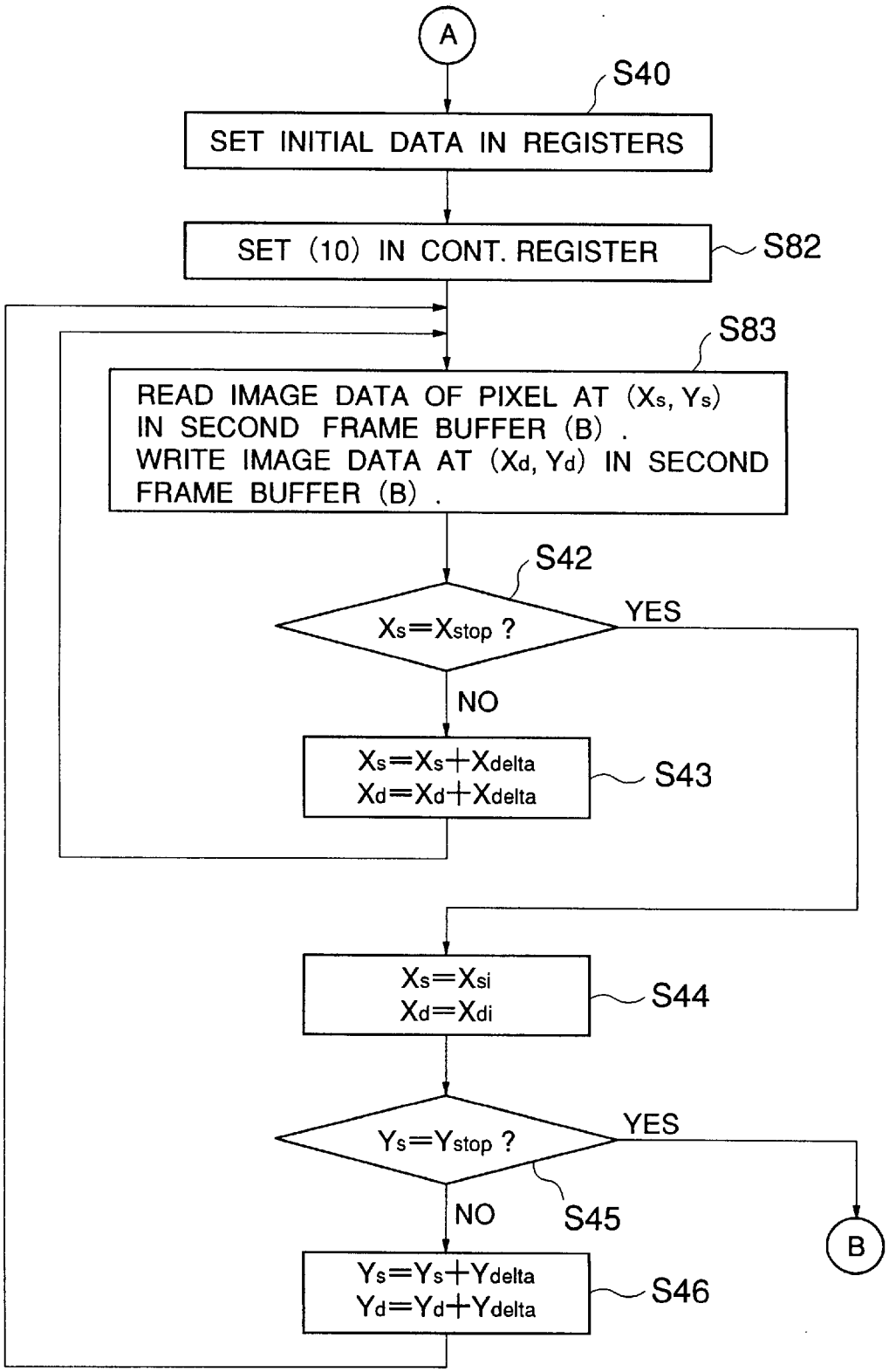
Figure 10C:
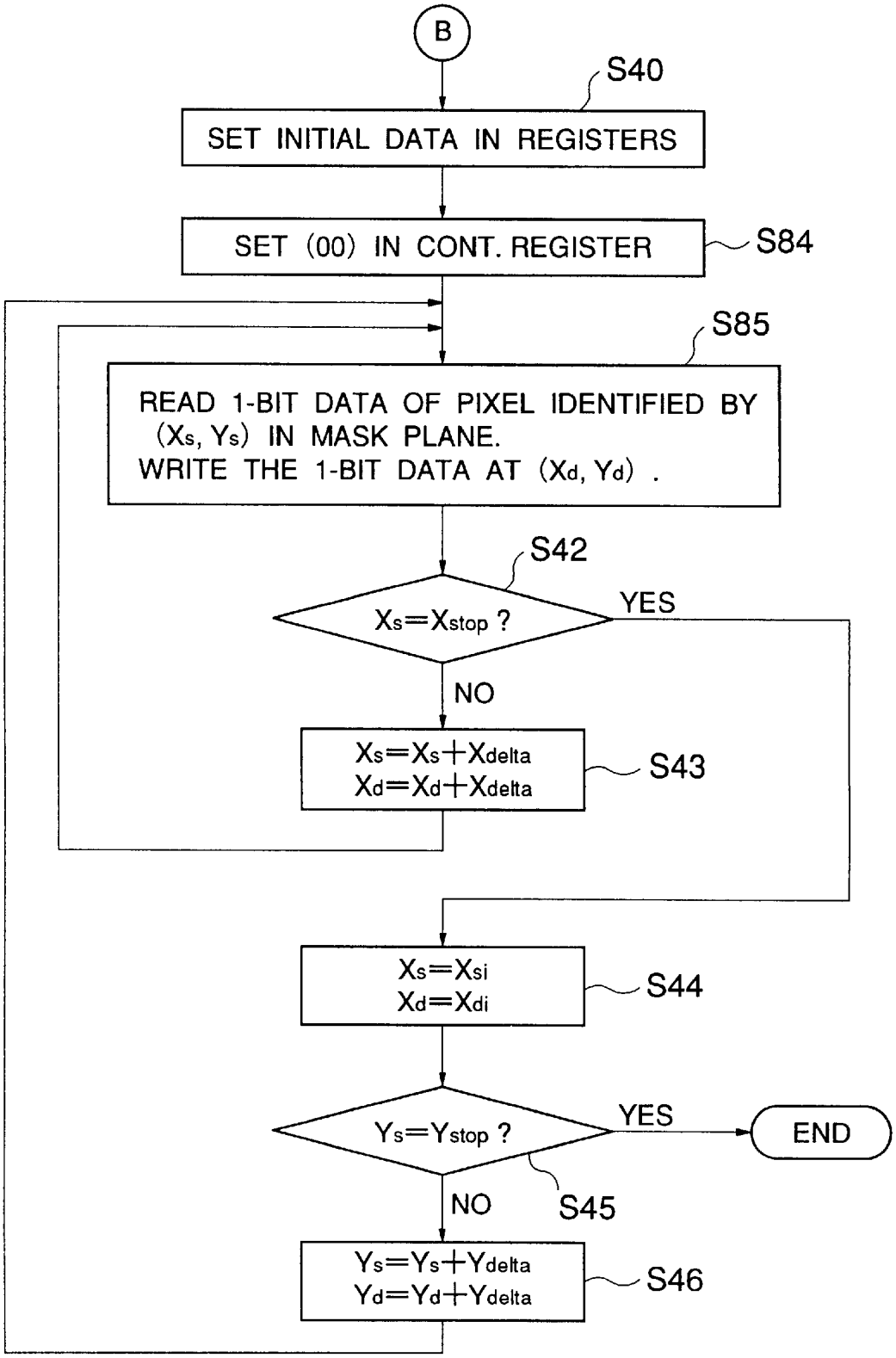

The display unit according to the fourth embodiment is formed as shown in FIG. 2A in the same manner as that according to the above embodiments. In the transfer process, the frame buffer control circuit 25 controls the first and second frame buffers 22 and 23 and the mask plane 41 in accordance with the flow charts shown in FIGS. 10A, 10B, and 10C. In FIGS. 10A, 10B and 10C, those steps which are the same as those shown in FIG. 5 are given the same reference numbers.

Image data of each pixel in an area corresponding to a parent window in the first frame buffer 22 is copied to an area corresponding to a transferred window in accordance with a process shown in FIG. 10A. Image data of each pixel in an area corresponding to the parent window in the second frame buffer 23 is copied to an area corresponding to the transferred window in accordance with a process shown in FIG. 10B. The 1-bit data ("0" or "1") of each pixel in an area corresponding to the parent window in the mask plane 41 is copied to an area corresponding to the transferred window in accordance with a process shown in FIG. 10C.

Referring to FIG. 10A, first, in step S40, various coordinate values are initially set in the registers 27, 28, 29, 30, 31 and 32, and the data −1 and/or +1 is initially set in the registers 39 and 40 in accordance with the process shown in FIG. 4. After this, control bits (0 1) are set in the control register 26 in step S80. The control signal based on the control bits (0 1) set in the control register 26 is then supplied to the first frame buffer 22 via the control bus 34, so that only the first frame buffer 22 is activated. In step S81, image data of a pixel identified by coordinates (Xs, Ys) is read out from the first frame buffer 22 and the image data is then stored in the first portion of the data register 33. Furthermore, in step S81, the image data stored in the first portion of the data register 33 is read out therefrom and returned to the first frame buffer 22. The image data returned to the first frame buffer 22 is written at a point identified by coordinates (Xd, Yd) in the first frame buffer 22. After that, due to steps S42–S46, the process in step S81 is repeated with the pixel to be processed being moved by one each time. As a result, image data in an area identified by the starting point S ($X_{start}$, $Y_{start}$) and the end point E ($X_{end}$, $Y_{end}$) is transferred to an area identified by transferred point dS ($X_{dst}$, $Y_{dst}$) in the first frame buffer.

After the image data is transferred in the first frame buffer 22, image data in the second frame buffer 23 is transferred in accordance with steps S40, S82, S83 and S42–S46 shown in FIG. 10B, in the same manner as that in the first frame buffer 22. In this case, control bits (1 0) are set in the control register 26, so that only the second frame buffer 23 is activated. After this, the 1-bit data in the mask plane 41 is transferred in accordance with steps S40, S84, S85 and S42–S46 shown in FIG. 10C, in the same manner as those in the first and second frame buffers 22 and 23. In this case, control bits (0 0) are set in the control register 26, so that only the mask plane 41 is activated.

According to the fourth embodiment, in the first and second frame buffers 22 and 23, image data in an area corresponding to the parent window is transferred to an area corresponding to the transferred window without determination whether image data included in each window is stored in the first frame buffer 22 or the second frame buffer 23 and without segmentation of the windows into the rectangular areas. Thus, image data can be rapidly transferred in each of the first and second frame buffers 22 and 23 so that images in the plurality of windows can be rapidly transferred on the screen.

Figure 11:
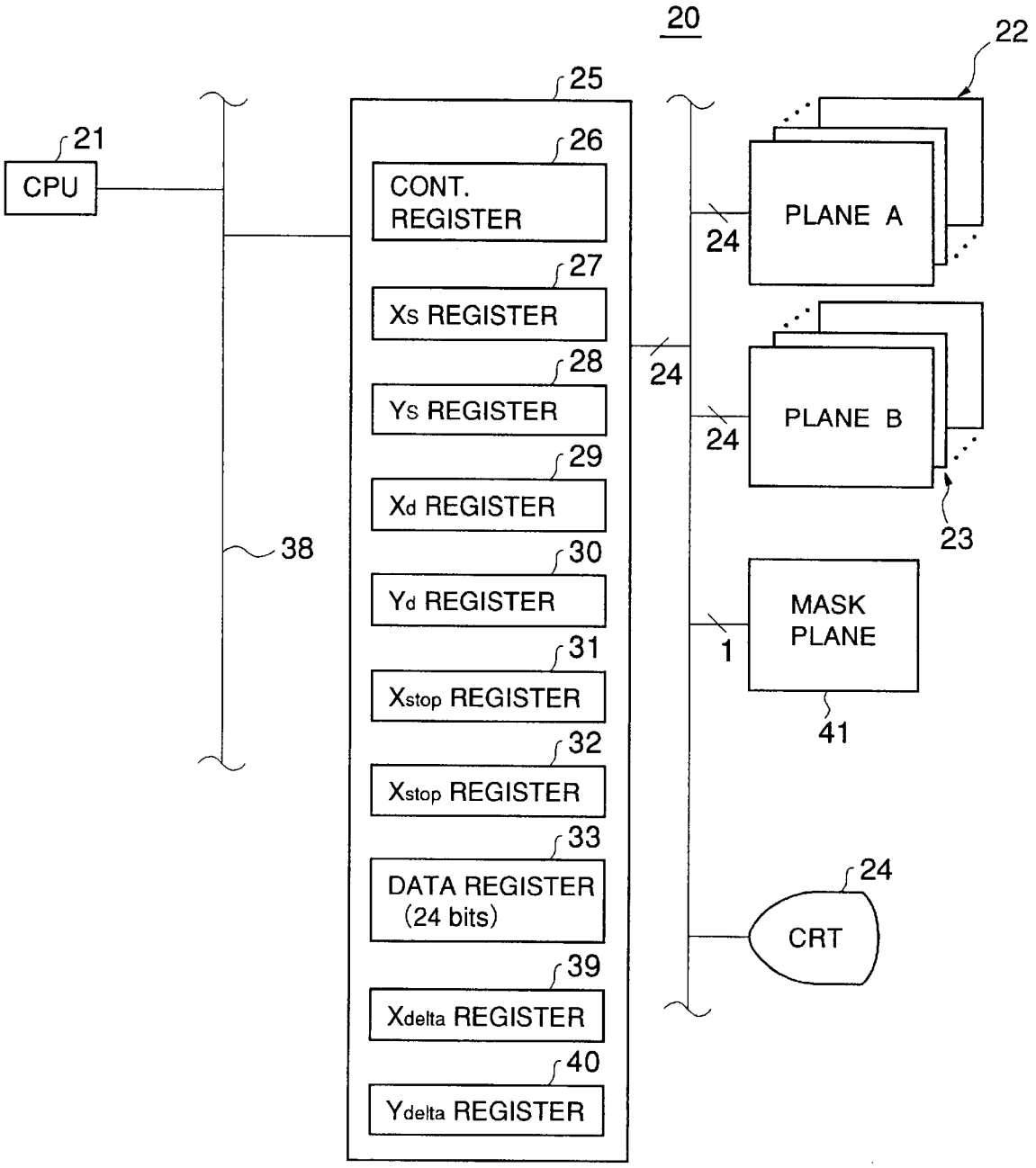
FIG. 11 is a block diagram illustrating a structure of a display unit according to another embodiment of the present invention.

The display unit may be formed as shown in FIG. 11. In the display unit shown in FIG. 11, the first frame buffer 22, the second frame buffer 23 and the mask plane 41 are coupled to the frame buffer control circuit 25 via the same bus having 24 bits. The data buffer 33 of the frame buffer control circuit 25 has a capacity of 24 bits. In this case, the first and second frame buffers 23 and 24 are not simultaneously accessed, such as in the process shown in FIG. 5, but are separately accessed. Thus, it is possible for the frame buffer control circuit 25 in this display unit to perform the processes shown in FIGS. 8, 9, 10A, 10B and 10C.

Also, in this case, in the first and second frame buffers 22 and 23, image data in an area corresponding to the parent window is transferred to an area corresponding to the transferred window without determination whether image data included in each window is stored in the first frame buffer 22 or the second frame buffer 23 and without segmentation of the windows into the rectangular areas. Thus, image data can be rapidly transferred in each of the first and second frame buffers 22 and 23 so that images in the plurality of windows can be rapidly transferred on the screen.

The present invention is not limited to the aforementioned embodiments, and variations and modifications may be made without departing from the scope of the claimed invention.

What is claimed is:

1. A display unit for displaying images included in a plurality of windows on a screen based on image data stored in a plurality of frame buffers, said display unit comprising:

a controller controlling said plurality of frame buffers to write image data into said plurality of frame buffers from said controller and to read image data out from said plurality of frame buffers into said controller; and a data transmission path coupling said controller and said plurality of frame buffers, said data transmission path allowing image data to be simultaneously written into each of said plurality of frame buffers from said controller and to be simultaneously read out from each of said plurality of frame buffers to said controller.

2. A display unit for displaying images included in a plurality of windows on a screen based on image data stored in a plurality of frame buffers, each of said plurality of buffers having an area corresponding to the area of the screen, said display unit comprising:

an initial setting device identifying a first area on the screen which includes images to be transferred to a second area on the screen; and a transfer device transferring, in each of the plurality of frame buffers, image data in a first area of a respective frame buffer corresponding to the first area identified by said initial setting device to a second area of the respective frame buffer corresponding to the second area on the screen, wherein the display unit uses the transferring image data in the respective second areas of the plurality of frame buffers to move the images in the first area on the screen to the second area on screen.

3. The display unit as claimed in claim 2, wherein the first area identified by said initial setting device includes said plurality of windows on the screen.

4. The display unit as claimed in claim 2, wherein, in addition to transferring image data from respective first areas to respective second areas of a corresponding frame buffer of said plurality of frame buffers, said transfer device writes image data to each of said plurality of frame buffers by separately writing image data into each of said plurality of frame buffers.

5. The display unit as claimed in claim 2, wherein said transfer device comprises:

a controller controlling said plurality of frame buffers to write image data into said plurality of frame buffers from said controller and to read image data out from said plurality of frame buffers into said controller; and a data transmission path coupling said controller and said plurality of frame buffers, said data transmission path allowing image data to be simultaneously written into each of said plurality of frame buffers from said controller and to be simultaneously read out from each of said plurality of frame buffers to said controller.

6. The display unit as claimed in claim 2, wherein said initial setting device further comprises:

a device identifying a point in the second area of the screen to which an image of an initial pixel in the first area of the screen is to be transferred; and a device identifying a direction in which the images are to be transferred on the screen.

7. The display unit as claimed in claim 2, further comprising a mask plane for storing data indicating a frame buffer of said plurality of frame buffers in which image data for each pixel on the screen is stored, image data corresponding to an image to be displayed on the screen being selected based on the data stored in said mask plane, wherein said transfer device transfers image data to the screen of each pixel in a respective frame buffer of said plurality of frame buffers indicated by the data stored in said mask plane.

8. A display unit for displaying images corresponding to a plurality of windows on a screen, based on image data corresponding to the images and stored in a plurality of frame buffers, the display unit comprising:

a controller holding image data and for controlling the plurality of frame buffers to transfer image data between the controller and the plurality of frame buffers; and a data transmission path coupling together the controller and the plurality of frame buffers, the data transmission path allowing image data to be simultaneously transferred into each of the plurality of frame buffers from the controller and simultaneously transferred out of each of the plurality of frame buffers to the controller.

9. A display unit which displays images on a screen and transfers images from a first area on the screen to a second area on the screen, the display unit comprising:

a plurality of frame buffers, each of the plurality of frame buffers having an area corresponding to the total area of the screen; and a transfer device transferring, in each of the plurality of frame buffers, image data in a first area of a respective frame buffer corresponding to the first area on the screen to a second area of the respective frame buffer corresponding to the second area on the screen, wherein the display unit uses the transferred image data in the respective second areas of the plurality of frame buffers to move the images in the first area on the screen to the second area on the screen.

10. The display unit as claimed in claim 9, wherein the transfer device comprises:

a controller holding image data and for controlling the plurality of frame buffers to write image data into the plurality of frame buffers from the controller and to read image data out from the plurality of frame buffers into the controller; and a data transmission path coupling the controller and the plurality of frame buffers, the data transmission path allowing image data to be simultaneously transferred into each of the plurality of frame buffers from the controller and simultaneously transferred out of each of the plurality of frame buffers to the controller.

11. The display unit as claimed in claim 9, further comprising a mask plane for storing data indicating a respective frame buffer of the plurality of frame buffers in which image data for each pixel on the screen is stored, image data corresponding to an image to be displayed on the screen being selected based on the data stored in the mask plane, wherein the transfer device transfers image data to the screen of each pixel in a respective frame buffer of the plurality of frame buffers in accordance with the data stored in the mask plane.

12. A display unit which displays images on a screen made of pixels and transfers images from a first area on the screen to a second area on the screen, the display unit comprising:

a plurality of frame buffers, each of the plurality of frame buffers having an area corresponding to the total area of the screen and storing image data;

a mask plane storing data indicating a respective frame buffer of the plurality of frame buffers in which image data for each pixel of the screen is stored, images displayed on the screen being formed by corresponding image data selected from the plurality of frame buffers in accordance with the data stored in the mask plane; and a transfer device transferring, within each of the plurality of frame buffers, image data in a first area of a respective frame buffer corresponding to the first area on the screen to a second area of the respective frame buffer corresponding to the second area on the screen, the display unit using the transferred image data in the respective second areas of the plurality of frame buffers to move the images in the first area on the screen to the second area on the screen, wherein the transfer device comprises a controller temporarily holding image data and for controlling the plurality of frame buffers to write image data into the plurality of frame buffers from the controller and to read image data out from the plurality of frame buffers into the controller, and a data transmission path coupling together the controller and the plurality of frame buffers, the data transmission path allowing image data to be simultaneously transferred into each of the plurality of frame buffers from the controller and simultaneously transferred out of each of the plurality of frame buffers to the controller.

* * * * *